US005999139A

United States Patent [19]

Benjamin et al.

[11] Patent Number: 5,999,139

[45] **Date of Patent: *Dec. 7, 1999**

[54] TWO-AXIS SATELLITE ANTENNA MOUNTING AND TRACKING ASSEMBLY

[75] Inventors: James A. Benjamin, Verona; David A. Haessig, Jr., Towaco; Peter Lindsay, Hardyston Township, all of N.J.

[73] Assignee: Marconi Aerospace Systems Inc., Wayne, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/924,418

[22] Filed: Aug. 27, 1997

[51] Int. Cl.[6] ..... H01Q 3/00

[52] U.S. Cl. ..... 343/765; 343/766; 343/757; 343/761

[58] Field of Search ..... 343/765, 761, 343/763, 757, 759, 882, 766

[56] References Cited

U.S. PATENT DOCUMENTS

| | | | |
|---|---|---|---|
| 3,296,621 | 1/1967 | Lapp | 343/765 |
| 4,598,297 | 7/1986 | Hawkins | 343/882 |
| 4,652,890 | 3/1987 | Crean | 343/882 |
| 4,811,026 | 3/1989 | Bissett | 343/766 |
| 5,471,219 | 11/1995 | Rodeffer et al. | 342/359 |
| 5,485,169 | 1/1996 | Kitabatake et al. | 343/765 |
| 5,517,205 | 5/1996 | van Heyningen et al. | 343/765 |

FOREIGN PATENT DOCUMENTS

| | | | |
|---|---|---|---|
| 2173643A | 2/1986 | United Kingdom | H01Q 3/08 |

*Primary Examiner*—Don Wong
*Assistant Examiner*—Jennifer H. Malos
*Attorney, Agent, or Firm*—D.L. Davis

[57] ABSTRACT

A two-axis satellite antenna mounting and tracking assembly including a universal joint for mounting the antenna to support structure. A pair of linear actuators offset at 90° to each other about the universal joint are operated in full-on/full-off fashion to control the azimuth and elevation orientations of the antenna. Satellite tracking is effected by maximizing received signal strength.

8 Claims, 4 Drawing Sheets

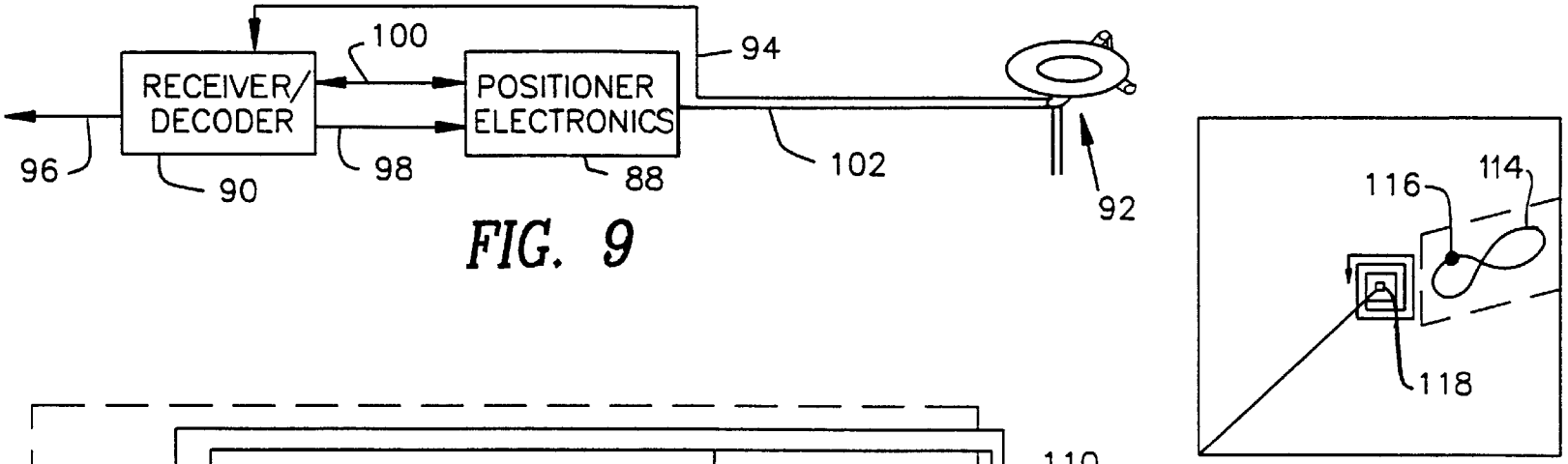
FIG. 9
FIG. 11
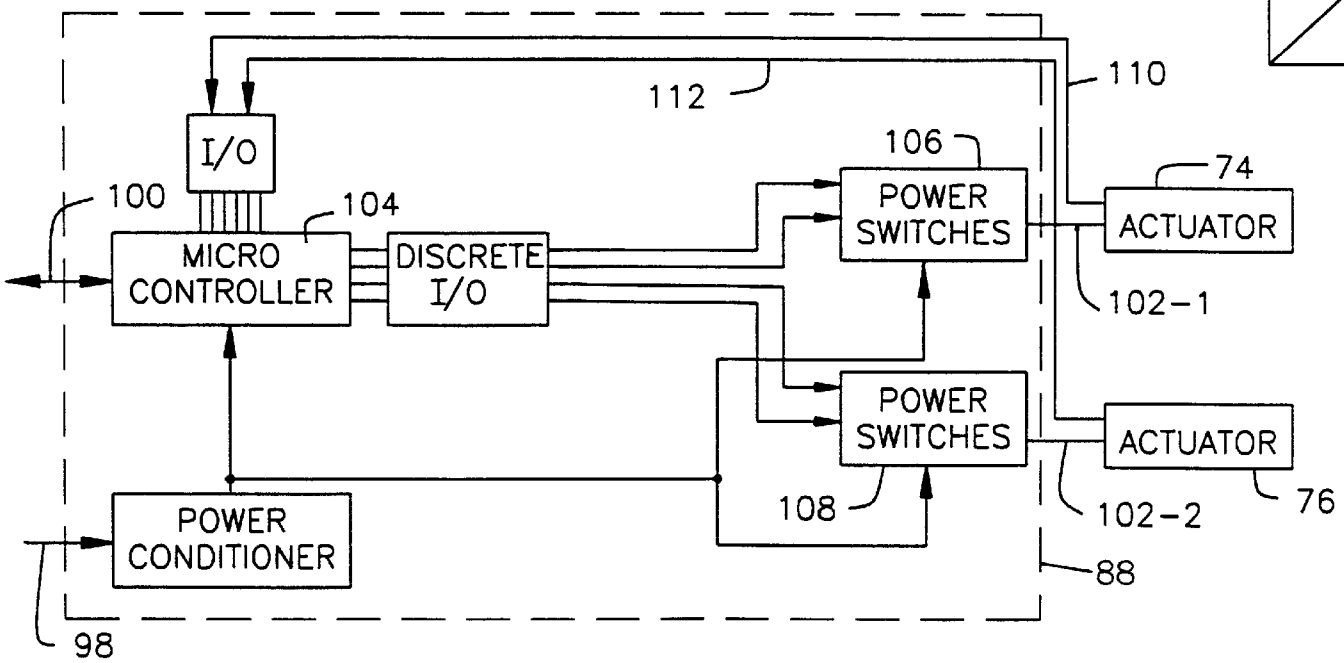
FIG. 10

TWO-AXIS SATELLITE ANTENNA MOUNTING AND TRACKING ASSEMBLY

BACKGROUND OF THE INVENTION

This invention relates to satellite antennas and, more particularly, to a low cost mounting and tracking assembly for such an antenna.

The Department of Defense is presently developing a global broadcast service (GBS) which uses satellites. In the interest of cost savings, these satellites are not stationary relative to the earth. Instead, the satellites wander within an approximately ±10° range in inclined orbits. The receiving stations for the GBS are either transportable or fixed, although when in use they remain in fixed positions. Therefore, whenever a receiving station is set up, the antenna must be pointed at a GBS satellite in view. Since the satellite wanders, the antenna must be movable to track the satellite after it is initially acquired. Further, the satellite mounting and positioning assembly must be rigid because the antenna is exposed (i.e., not within a radome) and is subject to winds.

Mounting and tracking assemblies for satellite antennas have been in use for many years. The most common type of such assembly is the elevation over azimuth two-axis gimbaled servo system. In such a system, the antenna is attached to an inner elevation gimbal which is supported through preloaded bearings on an outer azimuth gimbal structure. A drive motor, either rotary or linear, provides relative motion between the elevation and azimuth gimbals. The azimuth gimbal, in turn, is supported by preloaded bearings on a fixed structure and another drive motor provides relative motion between the azimuth gimbal and the fixed structure. The realities of physical packaging and the need to nest the elevation assembly inside the azimuth assembly when using such a system tend to make the use of linear, high gear ratio, actuators difficult, and push designers to rely upon rotary, low gear ratio, motors. The parts count, size, inertia and cost are comparatively high. Standardized gimbals do not exist, and therefore each application requires the design and fabrication of many large, customized, mechanical parts and precision features for mounting motors and bearings. Sealing against the environment also becomes an issue with such a system. As such, it provides the capability of directing the antenna line-of-sight in any direction in azimuth, and typically from 0° (horizontal) to +90° (vertical) in elevation. Accordingly, this type of positioner provides full hemispheric coverage. It is also known that elevation over azimuth positioners using linear actuators provide limited hemispheric coverage.

When applied to the problem of tracking an inclined satellite, as in the GBS, the gimbaled system previously described has a number of shortcomings. For example, full upper hemispherical coverage is not needed. When tracking a satellite in, for example, a 10° inclined orbit, the overall field-of-regard must be at least ±10° in both elevation and azimuth. The added rotational capability afforded by the gimbals results in unnecessary complexity, lower reliability, and increased cost. Further, the use of rotary motors and gearheads permits the back driving of the antenna in response to wind loading. The gear ratio in this type of system must be relatively low in order to provide the capability to slew the line-of-sight at high speed (i.e., 10° to 60° per second). This is necessary when the system is scanning for the satellite during initial acquisition. With these low gear ratios, it is possible for external disturbance torques to induce motion that drives the antenna line-of-sight off the satellite. Still further, most systems of this type use brushless DC motors or stepper motors. A disadvantage of this approach is that both types of motors require a motor drive amplifier.

Another type of assembly developed to track moving satellites involves the use of a fixed antenna with a movable feed which can effect a change in line-of-sight direction. The use of a fixed antenna permits the antenna to be rigidly attached to a base structure, which permits operation in high wind and eliminates the need for any type of antenna motion actuator. However, the range of motion possible using this approach is limited to about two beamwidths, which is often insufficient. For example, with a typical 0.75 meter 20 GHz dish antenna the beamwidth is 0.8°. Thus, a width of two beamwidths cannot track a satellite with an inclination greater than approximately 1.6°.

For all of the foregoing reasons, it would be desirable to provide a low cost satellite antenna tracking assembly which overcomes all of the foregoing problems.

SUMMARY OF THE INVENTION

According to the present invention, there is provided a mounting and tracking assembly for an antenna which comprises primary support structure adapted to be secured to a fixed support at a desired angular position about a first axis relative to the fixed support and secondary support structure secured to the primary support structure and including an adjustment mechanism for adjusting the angular position of the secondary support structure relative to the primary support structure about a second axis transverse to the first axis. A two-axis coupling has a first end secured to the secondary support structure and a second end secured to the antenna at a first point on the antenna. The coupling has a two-degrees-of-freedom pivot between its first and second ends. A first controllable bi-directional actuator has a first end secured to the secondary support structure and a second end secured to the antenna at a second point on the antenna along a first line passing through the first point. A second controllable bi-directional actuator has a first end secured to the secondary support structure and a second end secured to the antenna at a third point on the antenna along a second line transverse to the first line and passing through the first point. A controller is operative to selectively apply power to the first and second actuators to move the antenna about third and fourth axes through the two-degrees-of-freedom pivot, wherein the third and fourth axes are orthogonal to the first and second lines, respectively.

In accordance with an aspect of this invention, the first and second lines are orthogonal.

In accordance with another aspect of this invention, the second and third points are equidistant from the first point.

In accordance with yet another aspect of this invention, the two-axis coupling comprises a universal joint.

In accordance with still another aspect of this invention, a spring is coupled between the antenna and the secondary support structure.

In accordance with a further aspect of this invention, each of the first and second actuators comprises a linear actuator.

In accordance with still a further aspect of this invention, the antenna is a satellite antenna which requires a predetermined angular orientation for effective receipt of signals from the satellite. The controller includes a signal strength indicator arranged to provide an indication of the strength of the signal received by the antenna from the satellite, and first and second controllable bipolar drivers coupled to supply drive signals to the first and second actuators, respectively. A microcontroller is coupled to the signal strength indicator and to the first and second bipolar drivers and is programmed to operate in an initial acquisition mode wherein the first and second bipolar drivers are controlled to supply respective drive signals to the first and second actuators to move the antenna to an initial position and then to move the antenna in an expanding spiral-like pattern until the received signal strength is substantially maximized.

BRIEF DESCRIPTION OF THE DRAWINGS

The foregoing will be more readily apparent upon reading the following description in conjunction with the drawings in which like elements in different figures thereof are identified by the same reference numeral and wherein:

FIG. 9 is an overall block diagram of an illustrative control system for the inventive assembly;

FIG. 10 is a detailed block diagram for the positioner electronic section of the control system shown in FIG. 9; and FIG. 11 shows an illustrative tracking pattern according to this invention for the initial acquisition of a satellite.

DETAILED DESCRIPTION

Figure 3:
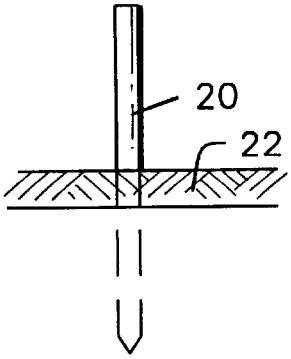
FIGS. 3–8 illustrate alternative fixed supports on which the inventive, assembly is mountable.
Figure 4:
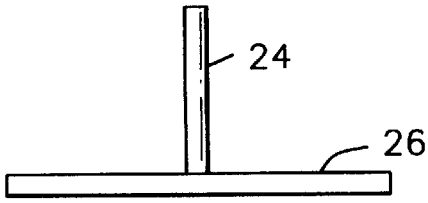
Figure 5:
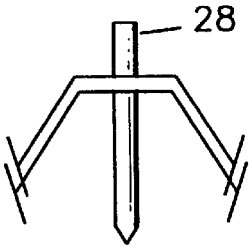
Figure 6:
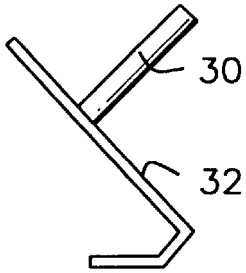
Figure 7:
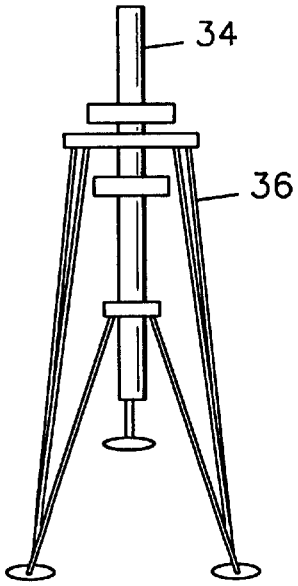
Figure 8:
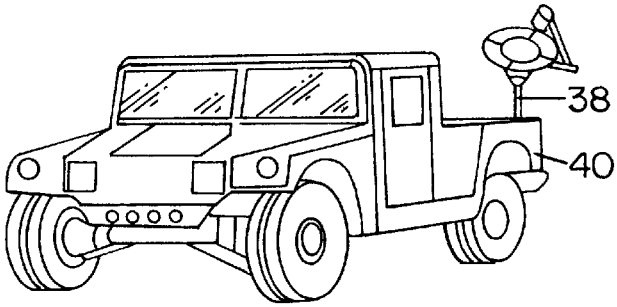

The drawings illustrate a mounting and tracking assembly for use with a satellite antenna which effects the tracking of a geosynchronous, earth orbiting, satellite in an inclined orbit and provides the capability for manually orienting the antenna for initial coarse alignment with the nominal satellite location. As previously discussed, the system is designed to be transportable, but fixed when in use. Specifically, the system is designed for mounting to any pipe having the proper diameter, illustratively two and one half inches. As shown in FIG. 3, the pipe 20 may be fixed in cement 22. As shown in FIG. 4, the pipe 24 may be welded to a base 26, which may be a flat plate. As shown in FIG. 5, the pipe 28 may be driven into the ground and tethered to stakes. As shown in FIG. 6, the pipe 30 may be welded to a flat plate 32 which is designed to be mounted to an angled roof. As shown in FIG. 7, the pipe 34 may be mounted to a tripod 36. As shown in FIG. 8, the pipe 38 may be welded to a plate (not shown) which is bolted to a vehicle 40. Other mountings may be devised by those of skill in the art and the present invention is not considered to be limited to the particular pipe mountings shown herein, which are for illustrative purposes only.

Figure 1:
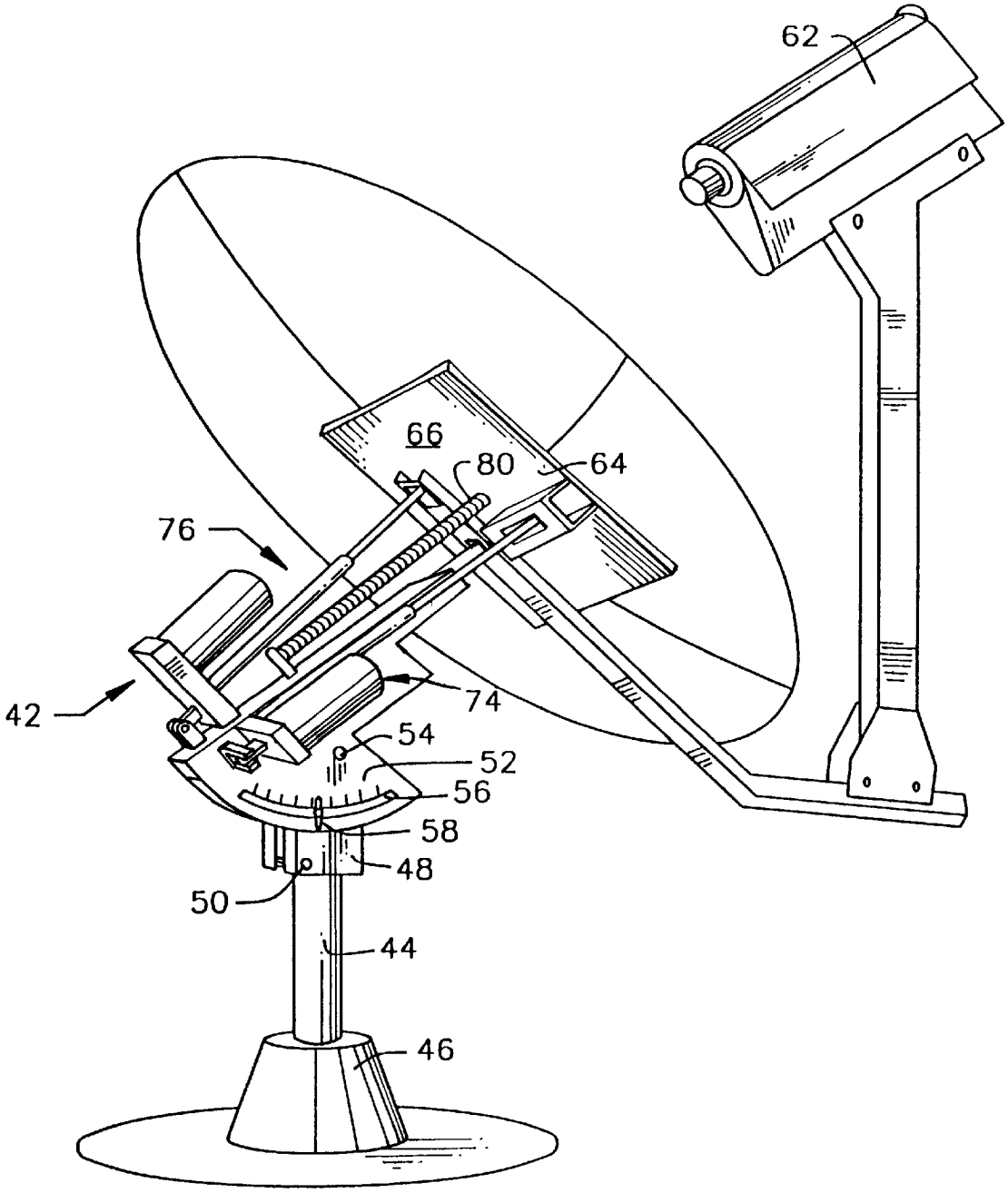
FIG. 1 is a perspective view showing a satellite dish antenna stalled on a mounting and tracking assembly according to an illustrative embodiment of the present invention.

As shown in FIG. 1, the mounting and tracking assembly according to this invention and designated generally by the reference numeral 42, is mounted to a pipe 44 on a base 46. The pipe 44 and the base 46 together act as a fixed Support for the assembly 42. The assembly 42 includes primary support structure 48, which may take the form of a channel member which is slid longitudinally over the upper end of the pipe 44. The channel member 48 is secured to the pipe 44 at a desired angular orientation, corresponding to azimuth, about the longitudinal axis of the pipe 44. A manual locking mechanism, such as a bolt 50, is used to clamp the channel member 48 to the pipe 44 so that initial manual azimuth positioning can be effected. In order to effect initial manual elevation positioning, there is provided secondary support structure 52 which is secured to the primary structure 48 about a pivot 54. The pivot 54 is orthogonal to the longitudinal axis of the pipe 44. An arcuate slot 56 centered at the pivot 54 is marked and/or detented in angular increments for movement relative to a pointer (not shown) fixed on the primary support structure 48 so that initial manual elevational adjustment of the assembly 42 may be effected and locked in place, illustratively by means of the wing nut 58, but other locking hardware, such as a locking lever, can be used as well.

Figure 2:
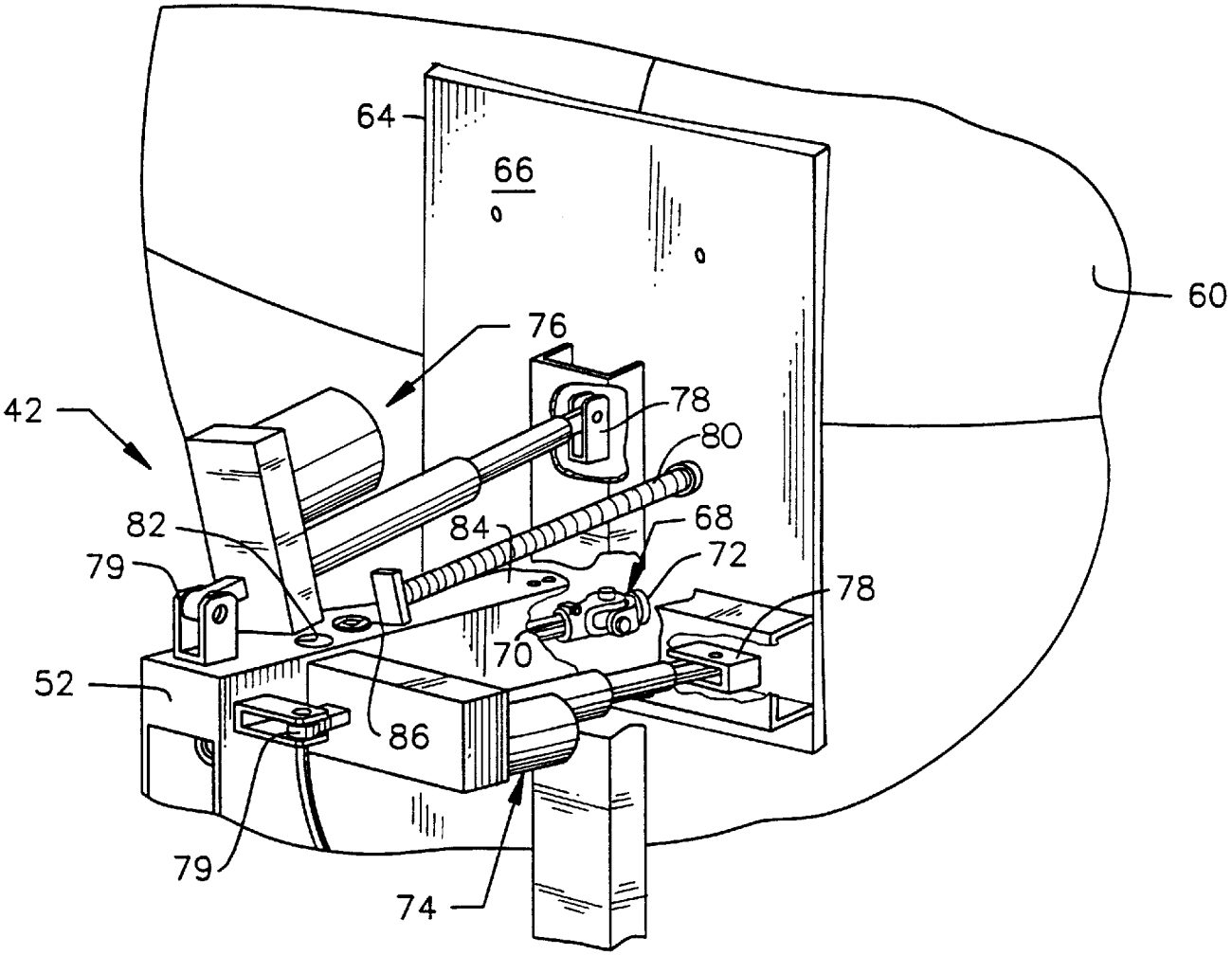
FIG. 2 is an enlarged perspective view, partially broken away, showing the mounting of the antenna to the inventive assembly shown in FIG. 1.

The assembly 42 is used for mounting the antenna 60, illustratively a satellite dish antenna having an offset feed 62, and for moving the antenna 60 within a limited range after it has been manually initially positioned for azimuth and elevation so that it tracks the geosynchronous inclined earth orbiting satellite. (Although for illustrative purposes a satellite dish antenna is shown, the present invention can be utilized with any type of directional antenna.) To secure the antenna 60 to the assembly 42, a backing plate 64 is fixed to the rear of the antenna 60. The backing plate 64 has a first surface which conforms to the rear surface of the antenna 60 and a second surface 66 which may be planar. To allow limited movement of the antenna 60 while at the same time securing it to the assembly 42, a two-axis coupling 68 (FIG. 2) is provided. The coupling 68 has a first end 70 secured to the secondary support structure 52 and a second end 72 secured to the antenna 60, via the plate 64, at a first point on the antenna. Preferably, the two-axis coupling 68 is a commercially available universal joint having a two-degrees-of-freedom pivot between its first and second ends 70, 72. Such a universal joint is advantageous in that it prevents motion about a third axis which is orthogonal to the two orthogonal axes of its pivot. Other types of couplings, such as a ball joint, can also be used.

To effect movement of the antenna 60 about the two axes of the coupling 68, a pair of controllable bi-directional actuators 74, 76 are provided. The actuators 74, 76 are preferably commercially available linear actuators which are driven in a full-on/full-off fashion. The use of linear actuators facilitates high structural rigidity of the drive mechanism such that its response to wind loading (i.e., the angular deflection of the antenna 60 line-of-sight due to wind) is very small. This permits the use of the antenna system outdoors without the protection of a radome. To effect motion about the two orthogonal axes of the coupling 68, the actuator 74 is coupled to the backing plate 64 at a point on a line which passes through the mounting point of the coupling 68 to the backing plate 64, this line being orthogonal to a line passing through the mounting point of the coupling 68 and the mounting point of the actuator 76 to the backing plate 64. The mounting of each of the actuators 74, 76 must provide for a limited degree of freedom at both the antenna 60 and the secondary support structure 52 of the assembly 42 to accommodate small angular misalignments due to changing antenna angle and cross coupling from the cross-axis motion of the antenna 60. These freedoms are achieved by using commercially available two-degrees-of-freedom rod-end pivots 78, 79 at both ends of each of the actuators 74, 76. The cross coupling is minimized or eliminated by having the pivots 78 in the plane of the axes of the coupling 68, which is parallel to the surface 66. The pivots 78, 79 are preferably commercially available devices in weather resistant form and the actuators 74, 76 are likewise preferably commercially available with environmental seals and simple pin mountings on each end. Accordingly, a cost effective construction is achieved. If inexpensive, "sloppy", actuators 74, 76 are used, to preload the assembly 42 so as to eliminate the effects of mechanical backlash in the actuators 74, 76, a spring 80 may be installed between the antenna 60 and the secondary support structure 52.

Before the automatic acquisition and tracking (to be described hereinafter) of the satellite can be commenced, a manual setup procedure must be followed. Initially, the technician must obtain the azimuth and elevation angles to the nominal satellite location. Knowing the latitude and longitude of the antenna location, the technician consults available tables to obtain the nominal azimuth and elevation angles. If the pipe 44 is vertical, after the primary support structure 48 is slipped over the end of the pipe 44, a compass 82 mounted on top of the secondary support structure 52 is used as an aid in moving the assembly 42 to the nominal azimuth angle. Thus, the primary support structure 48 is rotated on the pipe 44 until the needle of the compass 82 is at an angle equal to 360° minus the nominal azimuth angle. At this time, the primary support structure 48 is clamped to the pipe 44 by tightening the bolt 50. Next, the top surface 84 of the secondary support structure 52 is leveled using the spirit level 86 mounted to the top surface 84. This identifies the zero elevation angle location. The secondary support structure 52 is then tilted upward from the determined zero elevation angle to the nominal required elevation angle, and the wing nut 58 is tightened. The antenna 60 is now pointing substantially at the nominal satellite location.

If the pipe 44 is not vertical, as shown in FIG. 6 for example, the manual setup procedure takes into account the angle of the pipe 44. First, the assembly 42 is adjusted in both azimuth and elevation to bring the spirit level 86 to its null. This levels the top surface 84 of the assembly 42 and provides a base orientation for the assembly 42. The azimuth compass 82 angle and the elevation dial 56 are read and recorded. The recorded angles designate the row and column, respectively, in a table provided to the technician. The table used by the technician corresponds to the satellite azimuth and elevation angles for the antenna location longitude and latitude. The technician locates the cell in the table corresponding to the recorded angles, and reads the required azimuth and elevation angle values. The primary support structure 48 is then rotated through the required azimuth angle and locked into place by the bolt 50. The secondary support structure 52 is then pivoted through the required elevation angle and locked into position by the wing nut 58. The antenna 60 is then substantially aligned with the nominal satellite location.

After the manual setup procedure is completed, the assembly 42 must initially acquire and then track the satellite in order to maximize received signal strength. FIG. 9 is an overall block diagram showing an illustrative control system for the inventive assembly. This control system includes positioner electronics 88 and receiver/decoder 90 coupled to the antenna system 92. The receiver/decoder 90 receives radio frequency signals from the antenna system 92 over the leads 94, measures the received signal strength, and provides a received data stream over the leads 96 to circuitry (not shown) which utilizes the signals received from the satellite. Power is provided over the leads 98 to the positioner electronics 88 and data relating to the received signal strength is provided over a standard data link 100, which may be an RS422 type data link. The positioner electronics 88 provides control signals to the actuators 74, 76 over the leads 102.

FIG. 10 is a more detailed block diagram of the positioner electronics 88. The heart of the positioner electronics 88 is the microcontroller 104, which may be a type 8751 microcontroller. Based upon received signal strength signals over the link 100, the microcontroller 104 controls the power switches 106, 108 to provide proper polarity DC signals on the lead 102-1 to the actuator 74 and on the lead 102-2 to the actuator 76 to drive the actuators 74, 76 in full-on/full-off fashion. Position feedback from the actuators 74, 76 is provided to the microcontroller 104 over the leads 110, 112, respectively.

FIG. 11 illustrates the initial acquisition tracking pattern according to the present invention. The satellite in an inclined orbit follows a path illustratively shown by the figure eight curve 114, with the actual satellite position being denoted by the large dot 116. After the manual setup procedure has been completed and power has been applied to the system, the microcontroller 104 causes the actuators 74, 76 to each be driven to the center of their ranges, at the point 118. The microcontroller 104 then controls the actuators 74, 76 to move the antenna 60 in an expanding spiral-like pattern, preferably rectangular, while monitoring the received signal strength over the link 100. Once the received signal strength has been maximized, the system enters into an automatic tracking mode which follows peak signal strength, illustratively by moving the antenna from a steady state position incrementally in a predetermined pattern to a plurality of alternative positions surrounding the steady state position, and then defining as a new steady state position that position from among the group of the steady state and alternative positions at which the received signal strength is greatest. Thus, at regular intervals, the antenna is stepped up, down, right, and left, and then moved to the position where received signal strength is greatest.

The aforedescribed assembly is advantageous for a number of reasons. Thus, it uses readily available commercial off the shelf components, which significantly reduces its cost. The assembly contains a universal joint which permits the necessary two-degrees-of-freedom and constrains all others. The universal joint is simple, yet stiff, strong, reliable, and rugged in the face of severe environmental conditions. The assembly provides capability to manually point the antenna line-of-sight in any direction in the upper hemisphere relative to its mount, and to lock the line-of-sight in that position. The use of linear actuators permits high structural rigidity. The drive mechanism, which is typically the weakest link in the structural support, is in the present assembly very stiff, making it possible to make the overall structural support and drive mechanism highly rigid, such that its response to wind loading is very small. The actuators cannot be back driven or extended by application of an external force. Consequently, the actuators act as rigid structure, nearly equivalent to solid steel rods of similar dimension. This permits the use of the antenna system outdoors without the protection of a radome. The use of DC motors and the on/off control comprising extend, retract and stop commands, eliminates the motor drive amplifiers and commutation circuitry typically used in servo systems, thereby greatly simplifying the control electronic circuitry. The assembly does not require satellite ephemeris data to manually set up and initialize the antenna line-of-sight, nor does it require satellite ephemeris data to track the motion of an inclined orbit geosynchronous satellite. Thus, there is no requirement to update system parameters at periodic intervals.

Accordingly, there has been disclosed an improved low cost mounting and tracking assembly for a satellite antenna. While an illustrative embodiment of the present invention has been disclosed herein, it is understood that various modifications and adaptations to the disclosed embodiment will be apparent to those of ordinary skill in the art and it is intended that this invention be limited only by the scope of the appended claims.

What is claimed is:

1. A mounting and tracking assembly for an antenna, comprising:

primary support structure adapted to be secured to a fixed support at a desired angular position about a first axis relative to said fixed support;

secondary support structure secured to said primary support structure and including an adjustment mechanism for adjusting the angular position of said secondary support structure relative to said primary support structure about a second axis transverse to said first axis;

a two-axis coupling having a first end secured to said secondary support structure and a second end secured to said antenna at a first point on said antenna, said coupling having a two-degrees-of-freedom pivot between said first and second ends;

a first controllable bi-directional actuator having a first end secured to said secondary support structure through a first two-axis pivot and a second end secured to said antenna through a second two-axis pivot at a second point on said antenna along a first line passing through the first point;

a second controllable bi-directional actuator having a first end secured to said secondary support structure through a third two-axis pivot and a second end secured to said antenna through a fourth two-axis pivot at a third point on said antenna along a second line transverse to the first line and passing through the first point;

a spring coupled between said antenna and said secondary support structure effective to apply a preload force to said first and second actuators; and a controller operative to selectively apply power to said first and second actuators to move said antenna about third and fourth axes through said two-degrees-of-freedom pivot, said third and fourth axes being orthogonal to said first and second lines, respectively.

2. The assembly according to claim 1 wherein said first and second lines are orthogonal.

3. The assembly according to claim 2 wherein said second and third points are equidistant from said first point.

4. The assembly according to claim 1 wherein said two-axis coupling comprises a universal joint.

5. The assembly according to claim 1 wherein said first, second and third points define a plane which is orthogonal to a line joining said two-degrees-of-freedom pivot and said first point.

6. The assembly according to claim 1 wherein each of said first and second actuators comprises a linear actuator.

7. The assembly according to claim 1 wherein the antenna is a satellite antenna which requires a predetermined angular orientation for effective receipt of signals from a satellite and wherein the controller comprises:

a signal strength indicator arranged to provide an indication of the strength of a signal received by said antenna from said satellite;

a first controllable bipolar driver coupled to supply a drive signal to said first actuator;

a second controllable bipolar driver coupled to supply a drive signal to said second actuator; and a microcontroller coupled to the signal strength indicator and to the first and second bipolar drivers and programmed to operate in an initial acquisition mode wherein the first and second bipolar drivers are controlled to supply respective drive signals to said first and second actuators to move the antenna to an initial position and then to move the antenna in an expanding spiral-like pattern until the received signal strength is substantially maximized.

8. The assembly according to claim 7 wherein the microcontroller is further programmed to operate in a tracking mode after the initial acquisition mode wherein the first and second bipolar drivers are controlled to supply respective drive signals to said first and second actuators to move the antenna from a steady state position incrementally in a predetermined pattern to a plurality of alternative positions surrounding the steady state position and to define as a new steady state position that position from among the group of the steady state and alternative positions at which the received signal strength is greatest.

* * * * *